United States Patent [19]

Dahlgren

[11] 3,988,178

[45] Oct. 26, 1976

[54] METHOD FOR PREPARING SUPERCONDUCTORS

[75] Inventor: Shelley D. Dahlgren, Richland, Wash.

[73] Assignee: The United States of America as represented by the United States Energy Research and Development Administration, Washington, D.C.

[22] Filed: Nov. 29, 1974

[21] Appl. No.: 528,382

[52] U.S. Cl. ..... 148/133; 148/31.5; 148/32; 148/34; 148/127; 204/192

[51] Int. Cl.[2] ..... C22F 1/18; C23C 15/00

[58] Field of Search ..... 204/192; 148/31.5, 32, 148/34, 133, 127

[56] References Cited

UNITED STATES PATENTS

| | | | |
|---|---|---|---|
| 3,506,940 | 4/1970 | Corenzwit et al. | 148/133 X |
| 3,694,274 | 9/1972 | Giorgi et al. | 148/32 |
| 3,733,692 | 5/1973 | Fietz et al. | 29/599 |

OTHER PUBLICATIONS

J. Appl. Phys. vol. 43, No. 5, May 1972, pp. 2407–2411.

J. Appl. Phys. vol. 41, No. 12, Nov. 1970, pp. 4958–4962.

The Journal of Vacuum Sci. and Technology, vol. 18, No. 1, Jan.–Feb. 1971, pp. 180–183.

Journal of Applied Physics, vol. 44, No. 12, Dec. 1973, pp. 5595–5598.

*Primary Examiner*—C. Lovell

*Attorney, Agent, or Firm*—Dean E. Carlson; Arthur A. Churm; James W. Weinberger

[57] ABSTRACT

A superconductor having an equiaxed fine grain beta-tungsten crystalline structure found to have improved high field critical current densities is prepared by sputter-depositing superconductive material onto a substrate cooled to below 200° C. and heat-treating the deposited material.

8 Claims, 2 Drawing Figures

$Nb_3$ Al 0.75 Ge 0.25 superconductor sputtered on a substrate cooled to 20°C and heat treated 5 days at 750°C.

$Nb_3$ Al 0.75 Ge 0.25 composite of the best reported results for compounds sputter-deposited on heated substrates.

$Nb_3$ Al 0.75 Ge 0.25 superconductor sputtered on a substrate cooled to 20° C and heat treated 5 days at 750°C.

$Nb_3$ Al 0.75 Ge 0.25 composite of the best reported results for compounds sputter-deposited on heated substrates.

1000 Å

METHOD FOR PREPARING SUPERCONDUCTORS

CONTRACTUAL ORIGIN OF THE INVENTION

The invention described herein was made in the course of, or under, a contract with the United States Atomic Energy Commission.

BACKGROUND OF THE INVENTION

This invention relates to a method for preparing superconductors having improved high field critical current densities. More specifically, this invention relates to a method for preparing superconductors having an equiaxed fine grain beta-tungsten structure. Still more specifically, this invention relates to a method for preparing superconductors having an equiaxed fine grain beta-tungsten structure by sputter deposition.

As the requirements for larger electromagnets with higher magnetic fields increase, the importance of superconducting magnets increases. Of particular importance in making these magnets are the "hard" or type II superconductors, that is, superconductors which remain superconductive in the presence of intense magnetic fields. Of the type II superconductors, those compounds of the "beta-tungsten" (A-15) structure are the most promising. Examples of these superconductors (hereinafter referred to as A-15 compounds) are $NB_3Sn$, $V_3$ Ga, $Nb_3Al$ and $Nb_3Al_{0.75}Ge_{0.25}$.

High-field, A-15 compound superconductors are normally used in long lengths, either ribbon or fibers, or as coatings, and they are extremely difficult to make because they are very brittle and have substantially no plastic deformation characteristics. Diffusion processes have been developed for making $Nb_3Sn$ and $V_3Ga$ whereby a ribbon of niobium or vanadium is drawn slowly through molten tin or gallium; however, these methods have inherent drawbacks even for $Nb_3Sn$ and $V_3Ga$. Moreover, the methods are unworkable for making niobium-aluminum-germanium ($Nb_3Al_{1-x}Ge_x$) because chemical stoichiometry is impossible to attain and a multitude of intermetallic phases form during processing which render the product unusable. Furthermore, diffusion processed products contain expensive niobium, vanadium and gallium in the carrier ribbon and they also contain second phases which do not contribute to the superconductor's properties. Devices made from such material contain unneeded bulk which may also reduce performance levels.

Compounds of this type have also been prepared by sputter-deposition onto heated substrates and by vacuum vapor deposition onto very high-temperature substrates. While these methods produced thin films of compounds of the desired composition, the compounds either cracked and were unusable or produced critical current densities which were too low to be useful.

SUMMARY OF THE INVENTION

It has been found that by sputter-depositing superconductive material onto a substrate which is cooled rather than heated, and heat-treating the deposited superconductive material, it is possible to prepare superconductors of A-15 compounds which have a small equiaxed grain structure that has been found to give improved critical current densities at high magnetic fields.

According to this invention, superconductors having an equiaxed fine grain beta-tungsten structure are prepared by sputter-depositing superconductive material under a partial pressure of inert gas onto a substrate cooled to below about 200° C. to form a layer of superconductive material. The layer formed in this manner has generally a body-centered cubic-type crystal structure. The layer is then heat-treated at a temperature of from 550° to about 950° C. for a period of time sufficient to transform the body-centered cubic-type structure into an equiaxed fine grain beta-tungsten structure having superconductive properties.

It is therefore one object of the invention to provide a method for making superconductors by sputter deposition.

It is another object of the invention to provide a method for making superconductors having a fine grain equiaxed beta-tungsten grain structure.

Finally it is the object of the invention to provide a method for making superconductors having improved critical current densities at high magnetic field strengths.

DETAILED DESCRIPTION OF THE PREFERRED EMBODIMENT

Figure 1:
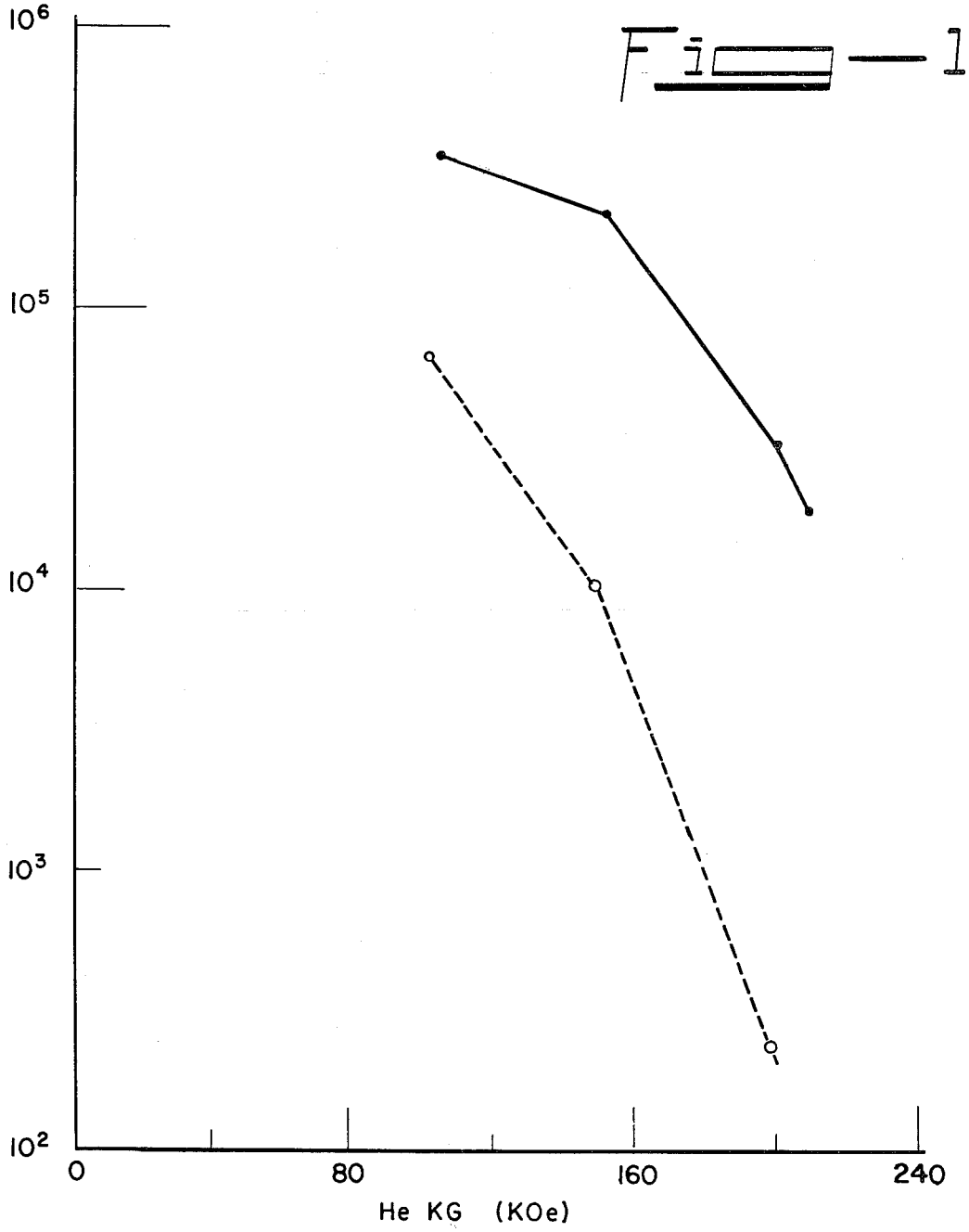
FIG. 1 is a graph comparing critical current densities between a $Nb_3Al_{0.75}Ge_{0.25}$ superconductor produced by prior art sputtering methods on a heated substrate and a superconductor of the same composition produced by the method of this invention.

These and other objects of the invention for preparing a superconductor having an equiaxed fine-grain beta-tungsten structure may be met by sputtering superconducting material as a compacted powder, under a partial pressure of inert gas, onto a suitable substrate cooled to from about 10° to 20° C. to deposit a layer of superconductive material thereon, the deposit having generally a body-centered cubic-type crystal structure, and heating the deposit to from about 650° to 850° C. for from about 1 hour to 5 days, whereby the generally body-centered cubic-type crystal structure is transformed into an equiaxed fine-grain beta-tungsten structure having superconducting properties.

The superconducting material to be sputtered may be either prealloyed superconducting metals or compacts of pure, very fine metal powders of superconducting materials which have been compressed into suitable sputtering targets. In general, the compacted powders are preferred, since purity and stoichiometry are easier to control.

The method of this invention is particularly useful for the preparation of superconductors of the brittle intermetallic A-15 compounds having the beta-tungsten crystalline structure such as $Nb_3Al$, $Nb_3Al_{0.75}Ge_{0.25}$, $Nb_3Ga$, $Nb_3Sn$ and $V_3Ga$.

It is important that the substrate upon which the superconductive material is deposited be cooled to below about 200° C. to insure formation of a homogeneous metastable solid solution having generally body-centered cubic-type crystal structure and to prevent decomposition of the deposited material which may result at higher temperatures. Substrate temperatures as low as 10° C. were satisfactory and excellent results were obtained from superconductive material deposited on substrates at 20° C. The substrate may be cooled by any convenient method which will maintain the temperature of the substrate at the desired level, such as a flow of compressed gas or running water on the back of the substrate.

Deposits made at 20° C. had a distorted body-centered cubic (bcc) crystal structure. Three very broad bcc X-ray diffraction lines have been found for Nb-Al-Ge, while $Nb_3Al$ deposited at 20° C. was clearly bcc, as was a $Nb_3Al_{0.75}Ge_{0.25}$ deposit made at a temperature of between 50° and 200° C.

A suitable substrate may be any smooth material which can be easily cooled and upon which the superconducting material can be readily sputter-deposited. It is preferable that the substrate have a thermal coefficient of expansion similar to the material being deposited in order to prevent cracks in the deposit and to permit heating of the superconductive material and substrate together. Examples of such suitable materials would be refractory materials such as niobium, tungsten, and some ceramic materials such as aluminum oxide. The substrate should have a smooth surface for good results, while a polished surface is preferred and a metallographically polished surface is most preferred. The substrate may have any shape which can be conveniently cooled and upon which deposits can be made, such as a flat plate, a long narrow strip or ribbon or a long wire which may be passed through the deposition chamber from one reel to another reel.

The sputtering apparatus by which deposition of the superconductive material is made is not critical, although the deposition should be at such a rate that the use of this method to prepare superconductors is feasible. A particular type of sputtering apparatus which was found to give a high rate of deposition is the triode sputtering apparatus where the plasma is formed independently as the positive column of a discharge maintained between a thermionic cathode and an anode. Sputtering is accomplished by inserting the target of superconductive material in this plasma as a separate negative electrode. The advantage of this apparatus is that high-purity deposits and a high sputtering rate are achievable. A schematic diagram of one such sputtering apparatus is shown on page 3 of BNWL-553, Application of Sputtering to the Fabrication of Neutron Detector Anodes, E. D. McClanahan, R. W. Moss and R. Busch, November 1967. The partial pressure may vary from 1 to about 200 microns and is best achieved by evacuating the reaction gases present in the sputtering apparatus and back-filling the apparatus with an inert gas such as krypton, xenon, argon, radon or helium.

The heat treatment of the deposits of superconductive material having the generally body-centered cubic-type structure may range from about 1 hour to about 20 days at temperatures which may vary from about 550° to about 950° C. The temperatures and time are dependent upon each other and may be varied. More specifically, the time at a given temperature must be that sufficient to transform the body-centered cubic-type crystal structure of the deposited superconductive material to the equiaxed fine-grain beta-tungsten structure which is the object of the method of the invention. It is desirable that heat treatment continue as long as possible to obtain maximum ordering and yet avoid decomposition and increased grain size in the deposited material. For example, the heat treatment of $Nb_3Al_{0.75}Ge_{0.25}$ at 750° C. was found to completely transform the generally bcc-type phase to the beta-tungsten grain structure. Critical temperatures are low and lattice parameters of the A-15 phase are high for very short heat treatment times, e.g. 1 hour. The critical temperature was found to reach a maximum of 18° K after heat treatment for 1 to 5 days at 750° C. while the lattice parameter reached a minimum after 5 days. Decomposition of the metastable A-15 phase at 750° C. was indicated after about 5 days. Heat treatment must be carried out under nonreactive conditions such as a vacuum or under an inert atmosphere.

While the method of this invention is useful for the production of A-15-type superconductors such as thin films of several hundred angstroms thickness, it is particularly useful for the preparation of thick films up to about 25 microns in thickness or greater, and which are important in superconductor technology, since they permit increased current capacity. While the preparation of thin films generally results in a relatively small grain structure, thicker films produced on a heated substrate were found to contain a columnar growth structure wherein the crystallites appeared to nucleate on the substrate and grow outward in a columnar fashion. This has resulted in an anisotropy of about a factor of 3 between planes parallel and perpendicular to the grain growth. With the fine-grain structure obtainable by the method of this invention, this anisotropy was reduced to about a factor of 0.7.

The following examples are given to illustrate the method of the invention and are not to be taken as limiting the scope of the invention.

EXAMPLE I

A sputtering target was prepared by mixing in a ratio of 12:3:1 very pure, powdered niobium, aluminum and germanium to form a powdered mixture which was simultaneously compacted into a target 4 cm in diameter and 6 mm thick and bonded to a 4 cm diameter by 6 mm thick copper support under vacuum at 600° C. and 150,000 N/cm$^2$. The substrate was metallographically polished copper of 4 cm diameter which was ion-etched just prior to deposition. Both the substrate and target support were welded to water-cooling enclosures so that they were part of the vacuum system and could be directly water-cooled from behind. The target was sputtered with 1500 eV krypton ions at 8.8 mA/cm$^2$ in a DC triode sputtering apparatus. A combination ion-titanium sublimation pump and chamber bakeout at about 200° C. were used to evacuate the initial sputtering chamber to $2.4 \times 10^{-9}$ Torr. The leak rate from the walls of the chamber after pumpdown was $5 \times 10^{-11}$ Torr - liter/sec with the valve to the high-vacuum pump closed. The krypton was controlled at $5 \times 10^{-3}$ Torr with an automatic leak valve during sputtering. The system was closed during sputtering except for the leak valve and there was no flow of sputtering gas through the system. The substrate was cooled to a temperature of 10° C. and the $Nb_3Al_{0.75}Ge_{0.25}$ was deposited thereon at a rate of 1 $\mu$/min to a depth of 66 microns in thickness. The deposits had a high metallic luster, were chemically homogeneous and void-free and deposit compositions were found to be very close to sputtering target compositions.

Samples 66 um thick, 1.25 mm wide and 3.2 cm long were cut from the deposit. Nitric acid was used to remove the copper substrate from the samples. The samples were then attached to 0.25 mm thick foil fixtures to prevent warping and sealed in quartz tubes which were evacuated to $10^{-7}$ Torr without bakeout and sealed off. The samples were then heat-treated for varying periods of time from 1 hour to 20 days.

Critical temperatures and lattice parameters of the material deposited at 10° C. were measured and compared with similar superconducting material deposited at higher temperatures. The results are shown in Table I below.

TABLE I

| Deposition Temperature | Post Deposition Heat Treatment at 750° C. | Lattice Parameter | Critical Temperatures T, onset of Superconductivity |
|---|---|---|---|
| 10° C. | None | Unresolvable | 5° K |
| | 1 hr | 5.182 A | 14.6 |
| | 1 day | 5.174 | 18.5 |
| | 5 days | 5.170 | 18.3 |
| | 20 days | 5.177 | 17.2 |
| 480° C. | None | 5.192 | 4.8 |
| | 1 hr | 5.185 | 15.0 |
| | 4 hrs | | 15.5 |
| | 5 days | 5.184 | 16.6 |
| | 20 days | 5.179 | 16.1 |
| 750° C. | None | 5.202 | 8.8 |
| | 5 days | 5.190 | 14.2 |
| | 20 days | 5.193 | 13.8 |

EXAMPLE II

To study the effect of heat-treatment temperature, samples of the $Nb_3Al_{0.75}Ge_{0.3}$ superconductors of Example I were heat-treated for one day at the stated temperatures. The results are shown in Table II below.

TABLE II

| Heat Treatment Temperature | Lattice Parameter | Critical Temperatures T, onset of Superconductivity |
|---|---|---|
| 500° C. | Untransformed | |
| 550 | 5.185 A | |
| 600 | | 11.3° K |
| 650 | 5.182 | 15.1 |
| 700 | 5.180 | 15.7 |
| 750 | 5.174 | 18.5 |
| 800 | 5.175 | 18.5 |
| 850 | 5.177 | 18.0 |

EXAMPLE III

Critical current densities ($J_c$) for $Nb_3Al_{0.75}Ge_{0.25}$ superconducting material prepared by the method of Example I, which were heat-treated 5 days at 750° C. on copper shunt material, are given in Table III below.

TABLE III

| Magnetic Field B (kilogauss) | $J_c$ B Parallel to Deposit Plane | $J_c$ B Perpendicular to Deposit Plane |
|---|---|---|
| 80 kg | $3.6 \times 10^5$ A cm² | $3.8 \times 10^5$ A cm² |
| 85 | 3.3 | 3.6 |
| 90 | 3.1 | 3.3 |
| 95 | 2.8 | 3.1 |
| 100 | 2.6 | 2.9 |
| 105 | | 2.6 |

EXAMPLE IV

A sample of $Nb_3Al_{0.75}Ge_{0.25}$ was prepared as described in Example I, except that it was deposited at a substrate temperature of 20° C. The deposit was encapsulated in a quartz tube and heat-treated for 20 days at 750° C. The critical currents were measured at 4.2° K and ranged from $2.5 \times 10^5$ A/cm² at 100 kOe to $1.5 \times 10^4$ A/cm² at 210 kOe. The critical currents were $1.3 \times 10^5$ A/cm² at 150 kOe and $2.6 \times 10^4$ at 200 kOe.

Figure 2:
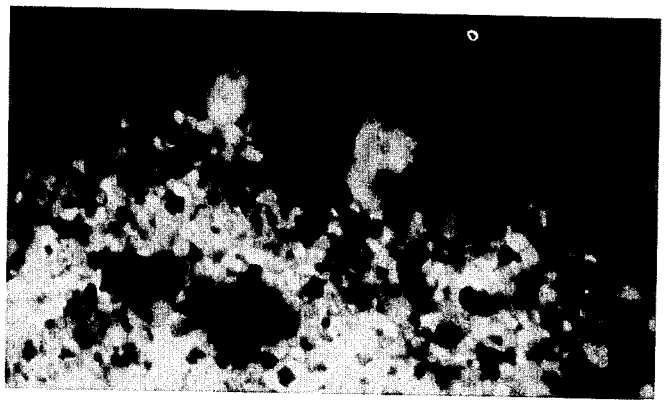
FIG. 2 is a transmission electron micrograph showing 350 A diameter grain structure in an $Nb_3Al_{0.75}Ge_{0.25}$ superconductor made by sputter deposition onto a 20° C. substrate and heat-treated at 750° C. for 5 days.

Some of the material prepared as above on a 20° C. copper substrate was heat-treated for 5 days at 750° C. FIG. 2 is a transmission electron micrograph showing the 350 A diameter grain structure of the deposit.

EXAMPLE V

A sputtering target was prepared by mixing in a ratio of 3:1 pure powdered niobium and aluminum to form a powdered mixture which was simultaneously compacted into a target and bonded to a copper support plate as described in Example I. The target was sputter-deposited under conditions as previously described onto a metallographically polished copper substrate cooled with running water to between 10° and 20° C. The $Nb_3Al$ was deposited at a rate of 1 micron per minute to a depth of about 250 microns. X-ray diffraction studies of the as-deposited material showed it to have a clearly body-centered cubic structure. A small sample of the deposited material was then sealed in an evacuated quartz tube and heat-treated at 750° C. for 5 days. X-ray diffraction studies of the treated sample indicated the bcc structure had been transformed into an A-15 phase of very fine grain size. The critical temperature ($T_c$) of the heat-treated sample was found to range from 17.1° to 17.4° K.

As can be seen from the above examples, the process of this invention provides high-quality superconductors having an equiaxed crystalline structure capable of providing high critical current densities at high magnetic field strengths.

The embodiments of the invention in which an exclusive property or privilege is claimed are defined as follows:

1. A method for preparing a superconductor having an equiaxial fine-grain beta-tungsten structure comprising:

a. sputtering superconductive material selected from the group consisting of $Nb_3Al$, $Nb_3Al_{0.75}Ge_{0.25}$, $Nb_3Ga$, $Nb_3Sn$ and $V_3Ga$, under a partial pressure of inert gas onto a substrate selected from the group consisting of copper, stainless steel, niobium and tungsten, cooled to and maintained from about 10 to 20° C. to deposit a layer of superconductive material thereon, said deposit having generally a body-centered-cubic type crystal structure, and b. heating the deposit of superconductive material to from 550° to 950° C. for a period of time sufficient to transform the body-centered-cubic type crystal structure into an equiaxial fine-grain beta-tungsten structure having superconductive properties.

2. The method of claim 1 wherein the layer of superconductive material is heated for a period of from 1 hour to 20 days.

3. The method of claim 1 wherein the superconductive material is $Nb_3Al$.

4. The method of claim 3 wherein the layer of superconductive material is heated for a period of from 1 hour to about 20 days.

5. The method of claim 1 wherein the superconductive material is $Nb_3Al_{0.75}Ge_{0.25}$.

6. The method of claim 5 wherein the layer of superconductive material is heated for a period of from 1 hour to about 20 days.

7. The method of claim 1 wherein the superconducting material is $Nb_3Al$, and the layer of superconducting material is heated to 750° C. for about 5 days.

8. The method of claim 1 wherein the superconducting material is $Nb_3Al_{0.75}Ge_{0.25}$, and the layer of superconducting material is heated to about 750° C. for about 5 days.

* * * * *